US006685496B2

(12) United States Patent
Ookura

(10) Patent No.: US 6,685,496 B2
(45) Date of Patent: Feb. 3, 2004

(54) CONNECTOR AND METHOD OF ASSEMBLING IT

(75) Inventor: Yoshio Ookura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/307,823

(22) Filed: Dec. 2, 2002

(65) Prior Publication Data

US 2003/0109166 A1 Jun. 12, 2003

(30) Foreign Application Priority Data

Dec. 6, 2001 (JP) ..... 2001-372844

(51) Int. Cl.[7] ..... H01R 13/62
(52) U.S. Cl. ..... 439/372; 439/586
(58) Field of Search ..... 439/372, 157, 439/364, 559, 557, 586, 587, 588, 589, 271

(56) References Cited

U.S. PATENT DOCUMENTS 5,971,791 A * 10/1999 Itoh et al. ..... 439/364
6,183,275 B1 2/2001 Okura et al.
6,305,957 B1 * 10/2001 Fink et al. ..... 439/157

FOREIGN PATENT DOCUMENTS

EP 1 032 085 8/2000
EP 1 150 393 10/2001

* cited by examiner

*Primary Examiner*—P. Austin Bradley
*Assistant Examiner*—Phuongchi Nguyen
(74) *Attorney, Agent, or Firm*—Gerald E. Hespos; Anthony J. Casella

(57) ABSTRACT

A connector includes a waiting-side housing (10) with a receptacle (14) for receiving a watertight housing (11). A grommet (21) and a grommet cover (22) are mounted on the watertight housing (11). A seal (31) with lips (31A) is formed at a portion of the grommet (21) projects toward the waiting-side housing (10). A squeezing wall (30) is provided at the back end of the receptacle (14) and is fittable over the seal (31). Thus, the lips (31A) are compressed in directions normal to a connecting direction between the squeezing wall (30) and the watertight housing (11) during a connecting operation, to provide sealing between the housings (10, 11).

10 Claims, 7 Drawing Sheets

CONNECTOR AND METHOD OF ASSEMBLING IT

BACKGROUND OF THE INVENTION

1. Field of the Invention

The invention relates to a watertight connector to be mounted on a panel and to a method of assembling it.

2. Description of the Related Art

U.S. Pat. No. 6,183,275 discloses a connector for mounting on a door panel of an automotive vehicle. The connector includes a waiting-side housing 1 that is fitted through a mount opening 2A formed in a panel 2, as shown in FIG. 7. The connector also includes a watertight housing 3 and a waterproof grommet 4 is mounted on the watertight housing 3. A seal 4A is provided at the front end of the opening edge of the grommet 4.

A grommet cover 5 is mounted on the watertight housing 3 and a lever 6 is supported rotatably on the grommet cover 5. The lever 6 is formed with a cam groove 6A and the waiting-side connector housing 1 is formed with a cam follower 1A that is engageable in the cam groove 6A. As a result, rotation of the lever 6 generates a cam action between the cam groove 6A and the cam follower 1A, and the watertight housing 3 is pulled into the waiting-side housing 1 together with the grommet 4 and the grommet cover 5. Further, upon completion of the rotation of the lever 6, the seal 4A of the grommet 4 is compressed in a connecting directions between a back surface 1B of the waiting-side housing 1 and the front end of the grommet cover 5, thereby providing sealing between the waiting-side and watertight housings 1, 3.

Secure sealing between the housings 1, 3 requires the seal 4A of the grommet 4 to be constantly compressed in the engaging directions by pushing the watertight housing 3 into the waiting-side housing 1. However, the lever 6 may shake relative to a shaft 7 and a bearing 6B that support the lever 6. Such shaking may be due to an engagement tolerance during molding or weakened rigidity due to repeated rotation of the lever 6. Consequently, the watertight housing 3 covered by the grommet 4 and the grommet cover 5 may shift when the housings 1, 3 are connected due to resilient forces of the seal 4A in the separating direction from the lever 6 and the waiting-side housing 1, which are locked into each other by the cam follower 1A and the cam groove 6A. As a result, the seal 4A cannot be pushed sufficiently against the back surface 1B of the waiting-side connector housing 1, and insufficient sealing may result.

The invention was developed in view of the above problem and an object thereof is to provide secure sealing between first and second housings, even if the watertight connector housing has a play in connecting direction.

SUMMARY OF THE INVENTION

The invention is directed to a connector with a first housing that is mountable onto a panel and a second housing that is engageable with the first housing. The second housing has a grommet for substantially covering the second housing, and the grommet has at least one seal that can be compressed in directions substantially normal to a connecting direction of the housings to provide sealing between the housings. Thus, the housings are prevented from relative shifting in the separating direction in response to a resilient force of the seal. Even if the housings shift relative to each other in the separating direction, the seal only moves in the separating direction while being kept in a compressed state. Therefore, the seal can constantly display its sealing function.

The seal preferably is arranged at least partly between the first housing and the second housing, and thus is compressed in directions substantially normal to the connecting direction.

Preferably, a movable member is provided on one of the first and second housings for displaying a cam action to connect or assist the connection of the first and second housings with each other. The movable member preferably comprises a lever formed with at least one cam groove. The lever is on one of the housings and the other of the housings has at least one cam follower engageable with the cam groove. The cam follower is displaced along the cam groove as the lever is rotated, thereby connecting and separating the second housing with and from the first housing.

The first housing may be a waiting-side housing that is mountable on a panel and the second housing may be a watertight housing that is engageable with the waiting-side housing.

The seal preferably is at a position to be squeezed between opposed surfaces of the housings in directions substantially normal to the connecting direction of the housings.

The seal is compressed in directions substantially normal to the connecting direction between engaging circumferential surfaces of the waiting-side and watertight housings to provide sealing between the housings. Therefore, the construction can be simplified.

Part of the seal preferably is a projecting wall and/or a groove formed circumferentially on or in a surface of the grommet substantially opposed to a surface of the waiting-side housing substantially along the connecting direction of the housings. Additionally, an engaging portion is formed circumferentially in or on the surface of the waiting-side housing substantially opposed to the surface of the grommet with the groove and/or a projecting wall. The seal can be compressed against the circumferential surface of the engaging portion in directions substantially normal to the connecting direction of the housings.

The seal of the grommet engages the engaging portion of the watertight connector housing as the housings are connected, and the seal is compressed against the circumferential surface of the mating engaging portion in directions normal to the connecting direction of the housings to provide sealing between the housings. Opposite side surfaces of the compressed sealing portion are in close contact with the engaging portion. Thus, more secure sealing can be provided between the housings.

The invention also relates to a method of assembling a watertight connector that has a first housing mountable onto a panel and a second housing engageable with the first housing. The method comprises providing the second housing with a grommet for substantially covering the second housing, and connecting the first and second housings to compress at least one seal of the grommet in directions substantially normal to a connecting direction of the housings to providing sealing between the housings.

The step of compressing the seal preferably comprises arranging the seal at least partly radially between the first and second housings, thereby compressing the seal substantially normal to the connecting direction.

The housings preferably are connected at least partly with each other by operating a movable member on one of the first and second housings, thereby displaying a cam action to connect or assist the connection of the first and second housings with each other.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
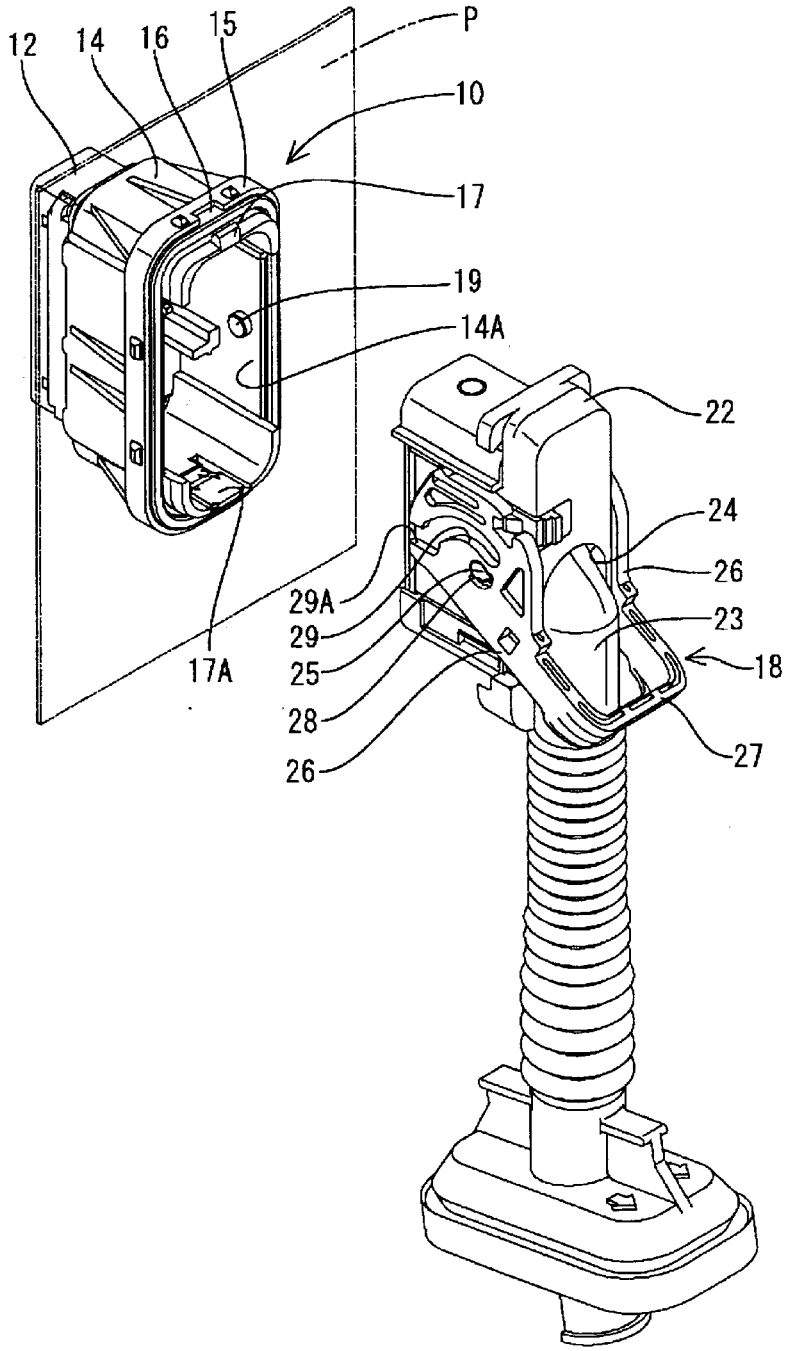
FIG. 1 is a perspective view showing waiting-side housing and watertight housings before connection.
Figure 2:
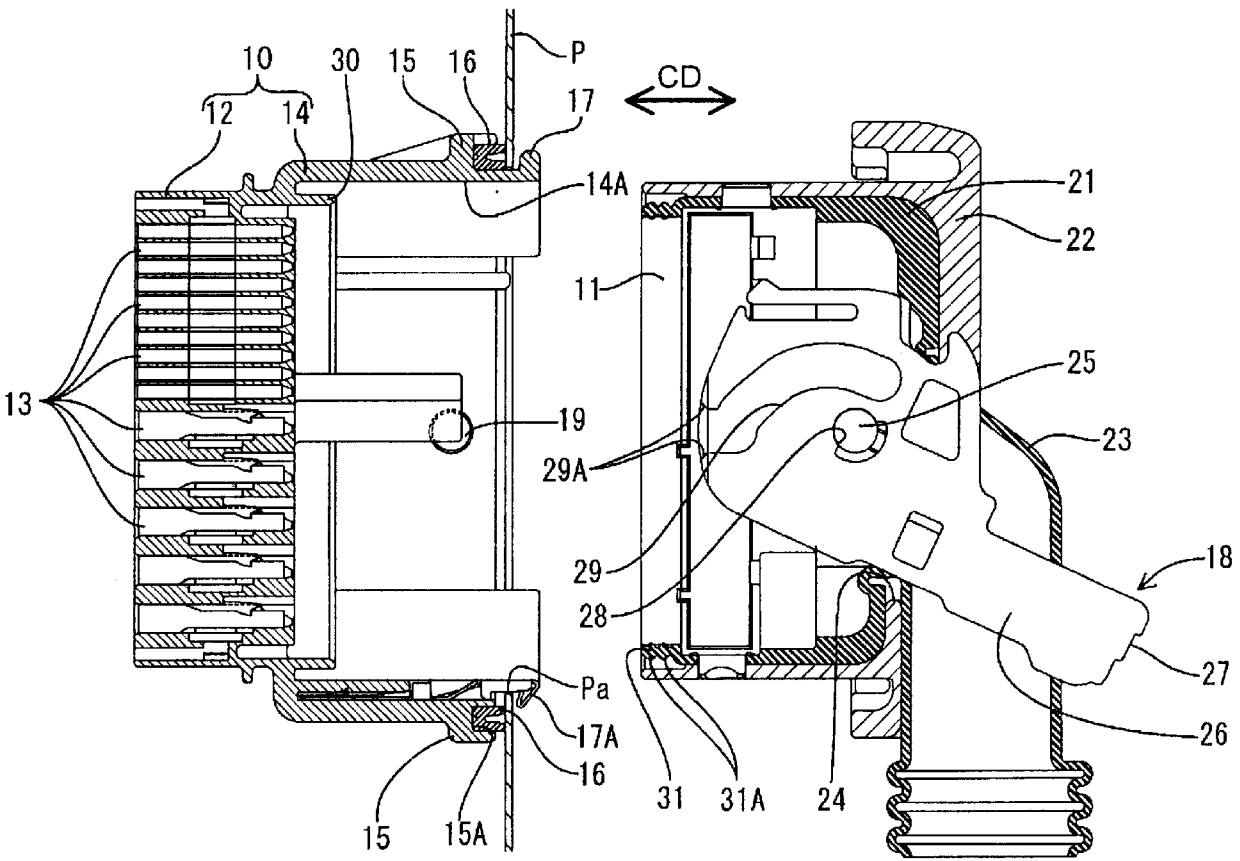
FIG. 2 is a side view partly in section of the waiting-side and watertight housings before the connection.
Figure 3:
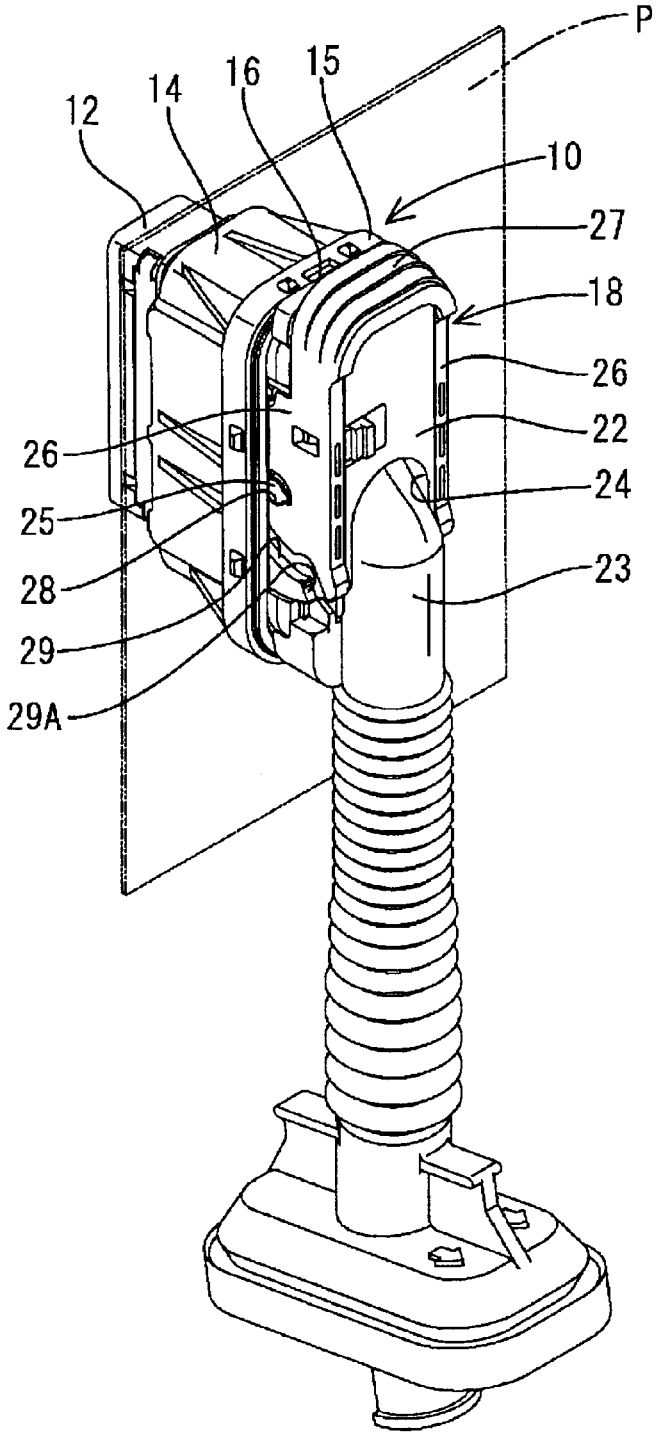
FIG. 3 is a perspective view of the waiting-side and watertight housings when being properly connected.
Figure 4:
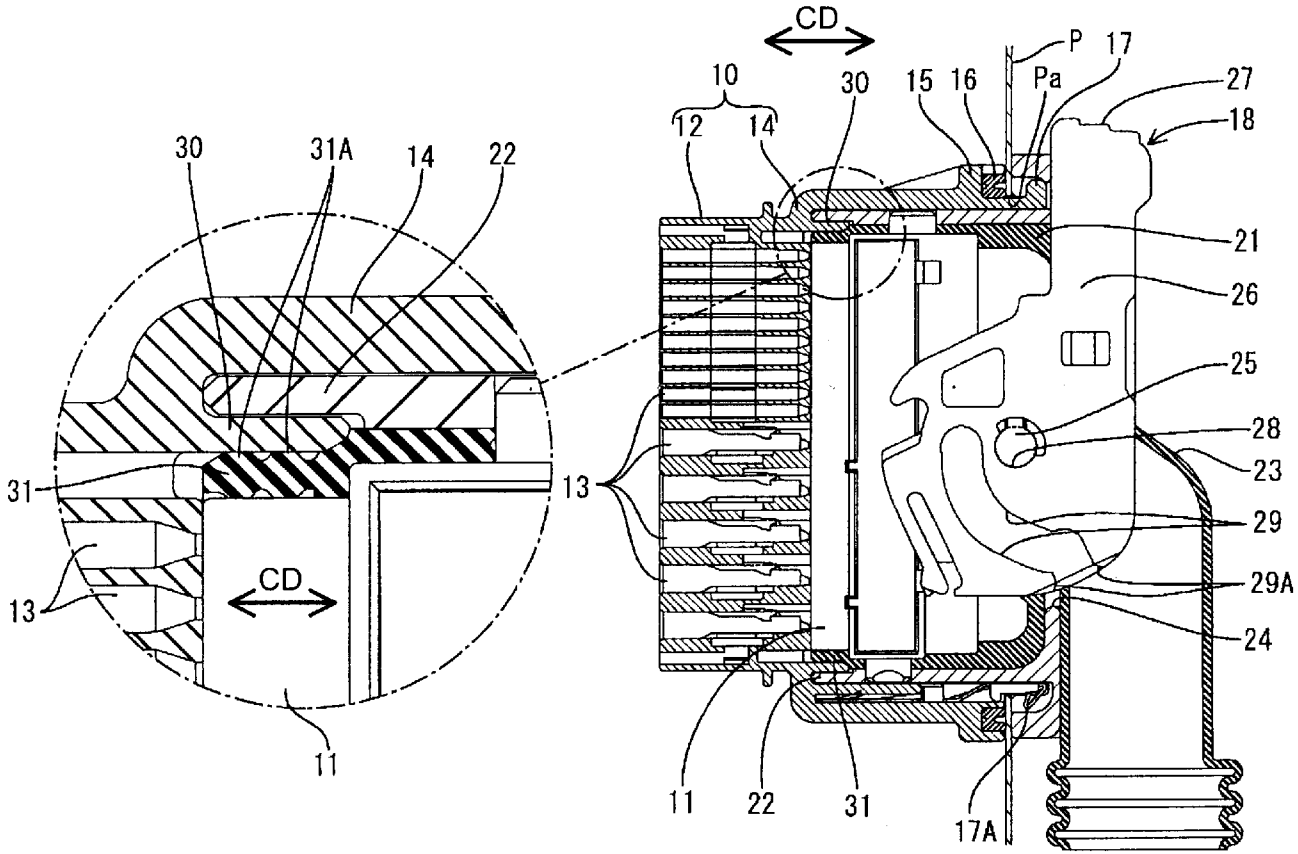
FIG. 4 is a side view partly in section of the waiting-side and watertight housings when being properly connected with a portion near a seal.

A connector according to a first embodiment includes a waiting-side housing 10 and a watertight housing 11 that are connectable with each other along a connecting direction CD, as shown in FIGS. 1 to 4. In the following description, mating sides of the waiting-side and watertight housings 10, 11 are referred to as front sides and terminal fittings are not illustrated to simplify the drawings.

The waiting-side housing 10 has a main body 12 with cavities 13 for receiving male terminals (not shown) so that tabs of the male terminals project into a receptacle 14. A flange 15 is provided on at least part of the outer circumferential surface of the leading end of the receptacle 14 and a ring-shaped resilient seal 16 is mounted on the front surface of the flange 15. The leading end of the receptacle 14 is inserted into a mount opening Pa in a panel P to mount the waiting-side housing 10 onto the panel P. An engaging claw 17 is provided at the upper end of the receptacle 14 and engages the upper edge of the mount opening Pa. Additionally, a resilient locking claw 17A at the lower end of the receptacle 14 engages the lower edge of the mount opening Pa. The seal 16 then can be brought closely into contact with the entire circumferential edge of the mount opening Pa. Thus, the panel P and the waiting-side housing 10 are connected with each other and a seal is provided therebetween.

The receptacle 14 is open along the opening edge of the mount opening Pa while the waiting-side housing 10 is mounted on the panel P. The watertight housing 11 then enters the receptacle 14 through an opening 14A and is connected with the waiting-side housing 10. Further, two cam followers 19, which preferably are concentric pins, project at the left and right inner surfaces of the receptacle 14.

The watertight housing 11 has cavities (not shown) for accommodating female terminals (not shown) therein, and is provided with a grommet 21 made of a rubber or other resilient material. The grommet 21 is mounted from behind to cover all outer surfaces of the watertight housing 11 excluding the front surface. A grommet cover 22 made of a hard shape-maintaining resin covers substantially the whole body of the grommet 21 excluding the front surface from the backside of the grommet 21. A tubular wire draw-out portion 23 is provided at the back surface of the grommet 21 and a bundle of wires connected with the female terminals can be inserted through the wire draw-out portion 23. A through hole 24 is formed in the back surface of the grommet cover 22 for avoiding the wire draw-out portion 23, and two shaft pins 25 project at the left and right lateral outer surfaces of the grommet cover 22.

A substantially U-shaped lever 18 is mounted on the grommet cover 22 and spans the grommet cover 22. The lever 18 has two arms 26 and an operable portion 27 coupling the arms 26. Each arm 26 has a bearing hole 28 to be engaged with the corresponding shaft pin 25. The lever 18 is rotatable or pivotable about the pins 25 between a first position where the lever 18 is located before a connecting operation (see FIG. 2) and a second position where the lever is located after (see FIG. 4) the connecting operation.

Each arm 26 is formed with a cam groove 29 substantially corresponding to the cam follower 19. The cam groove 29 extends around the bearing hole 28 in a converging manner toward the bearing hole 28, e.g. spiral-like. One end of each cam groove 29 serves as a receiving portion 29A for receiving and engaging the cam follower 19 when the watertight housing 11 is fitted into the receptacle 14. The engaged cam followers 19 are displaced along the cam grooves 29 as the operation arms 26 are rotated, thereby pulling the watertight housing 11 into the receptacle 14.

An tubular squeezing wall 30 is formed at the back of the receptacle 14 of the waiting-side housing 10 and surrounds the front side of the main body 12. The squeezing wall 30 is substantially concentric within the receptacle 14 and is spaced inwardly from the outer portion of the receptacle 14.

The grommet 21 is mounted so that the inner surface thereof is held in close contact with the outer surfaces of the watertight housing 11. The front end of the grommet 21 is substantially flush with the leading end of the watertight housing 11. A seal 31 is provided at a portion of the leading end of the grommet 21. The seal 31 overlaps the squeezing wall 30 of the waiting-side housing 10 along the connecting direction CD when the housings 10, 11 are connected with each other. A portion of the grommet cover 22 that is to overlap the seal 31 along the connecting direction CD is thinned slightly in a thickness direction, and a clearance is defined between the seal 31 and the grommet cover 22 for receiving the squeezing wall 30. Thus, when the housings 10, 11 are connected properly, the receptacle 14, the thinned portion of the grommet cover 22, the squeezing wall 30, the seal 31 and a part of the main body 11 overlap along the connecting direction CD in this order from the outer side to the inner side (see FIG. 4) and the distances between the squeezing wall 30 and the part of the main body 11 is set such that the seal 31 is compressed therein in a direction substantially normal to the connecting direction CD.

Two lips 31A extend around each of the inner and/or outer surfaces of the seal 31. A space between peaks of the outer lips 31A and the inner surface of the grommet cover 22 is less than the thickness of the squeezing wall 30, so that the lips 31A are compressed in directions substantially normal to a connecting direction between the squeezing wall 30 and the watertight housing 11 when the squeezing wall 30 is fitted into the clearance between the thinned portion of the grommet cover 22 and the seal 31 thereby deflecting the seal 31 inwardly and compressing it between the squeezing wall 31 and the main body of the watertight connector 11.

The watertight housing 11 initially is covered with the grommet 21 and the grommet cover 22. Thus assembly then is fit in the connecting direction CD into the receptacle 14 of the waiting-side housing 10 that has been mounted on the panel P with the lever 18 located at the position shown in FIG. 2. Thus, the cam followers 19 enter the receiving portions 29A of the cam grooves 29. The lever 18 then is rotated so that the cam followers 19 are displaced along the cam grooves 29, and so that the watertight housing 11 is pulled into the receptacle 14. The lever 18 is rotated or pivoted to the position shown in FIG. 4 to complete the connection of the housings 10, 11. At this stage, the squeezing wall 30 is fit between the seal 31 and the grommet cover 22, and the lips 31A are compressed in directions substantially normal to the connecting direction CD of the connector housings 10, 11 between the inner surface of the squeezing wall 30 and the outer surface of the watertight housing 11. Thus, the squeezing wall 30, the seal 31 and the grommet cover 22 are arranged with respect to each other at a distance to compress the resilient seal 30 in the direction substantially normal to the connecting direction CD. Therefore, the seal 31 is sealingly kept in close contact with the inner surface of the squeezing wall 30 and the outer surface of the watertight housing 11, thereby providing watertight sealing between the housings 10, 11.

Stable sealing between the housings 10, 11 requires the seal 31 to be compressed constantly by exerting a force of the same intensity in the directions of compression of the seal 31. The seal 31 is compressed at an angle between about 70° and about 110° (i.e. substantially normal) to the connecting direction CD by the squeezing wall 30. Additionally, the front end of the seal 31 does not contact the back of the receptacle 14, and hence is not compressed along the connecting direction CD. The engaged shaft pins 25 and 28 could shake with respect to each other. However, the watertight housing 11 is not displaced in separating direction from the waiting-side housing 10 since the seal 31 exerts substantially no force on the watertight housing 11 in the connecting direction CD. Even if the watertight housing 11 moves in the separating direction, the seal 31 only moves back along the squeezing wall 30 while being compressed. Therefore, there is no change in the compressed state of the seal 31 in directions normal to the connecting direction CD, and the close contact state of the outer surface of the watertight housing 11 and the inner surface of the squeezing wall 30 remains. Thus, secure sealing can be provided between the housings 10, 11.

The above-described effects are obtained by defining the clearance between the seal 31 at the leading end of the grommet 21 and the grommet cover 22, and by providing the squeezing wall 30 that projects from the back of the receptacle 14 for fitting into the clearance. Therefore, the constructions of the housings 10, 11 can be simplified.

Figure 5:
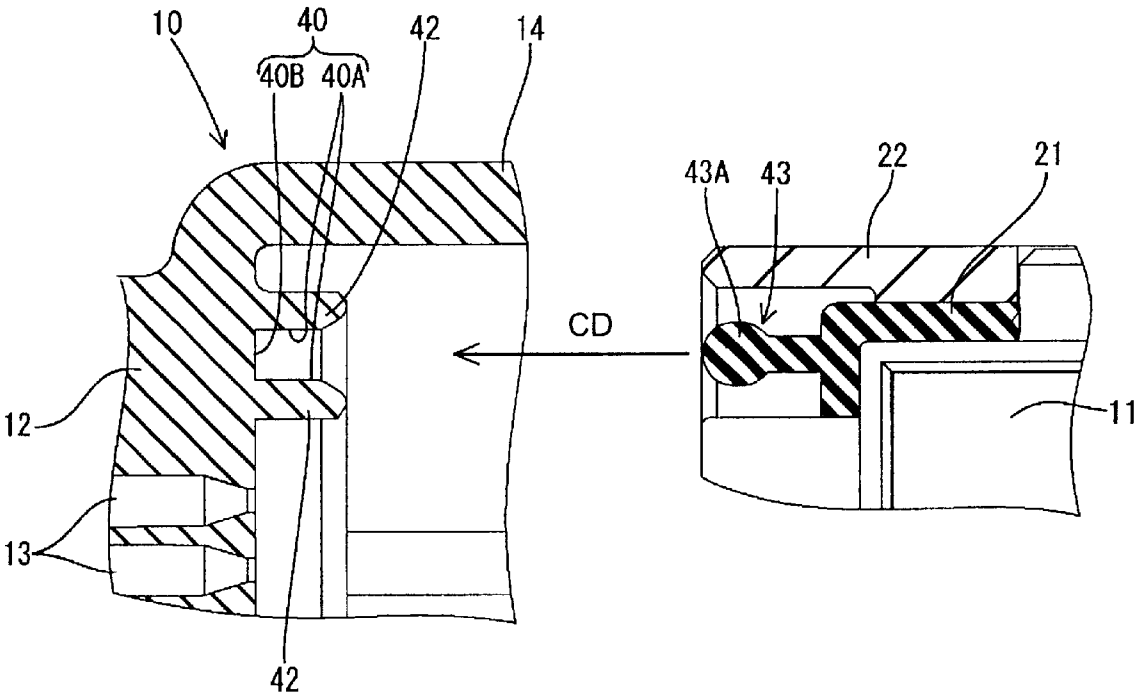
FIG. 5 is a fragmentary side sectional views enlargedly showing an engaging portion and a seal of the second embodiment before connection.
Figure 6:
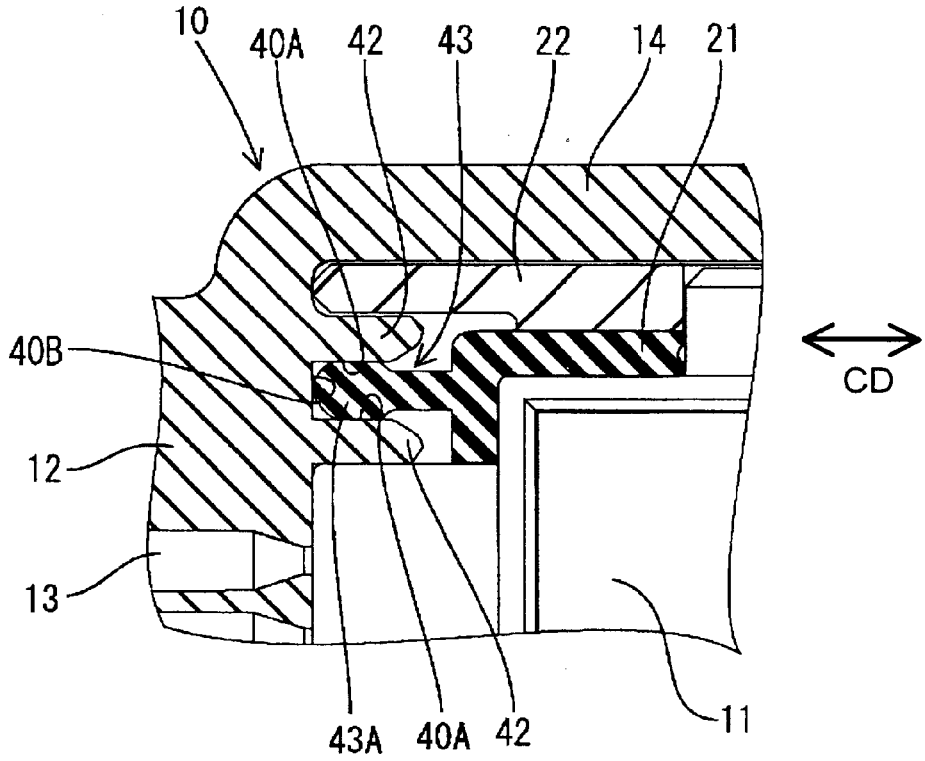
FIG. 6 is a fragmentary view enlargedly showing the engaging portion and the seal of the second embodiment at the time of proper connection.
Figure 7:
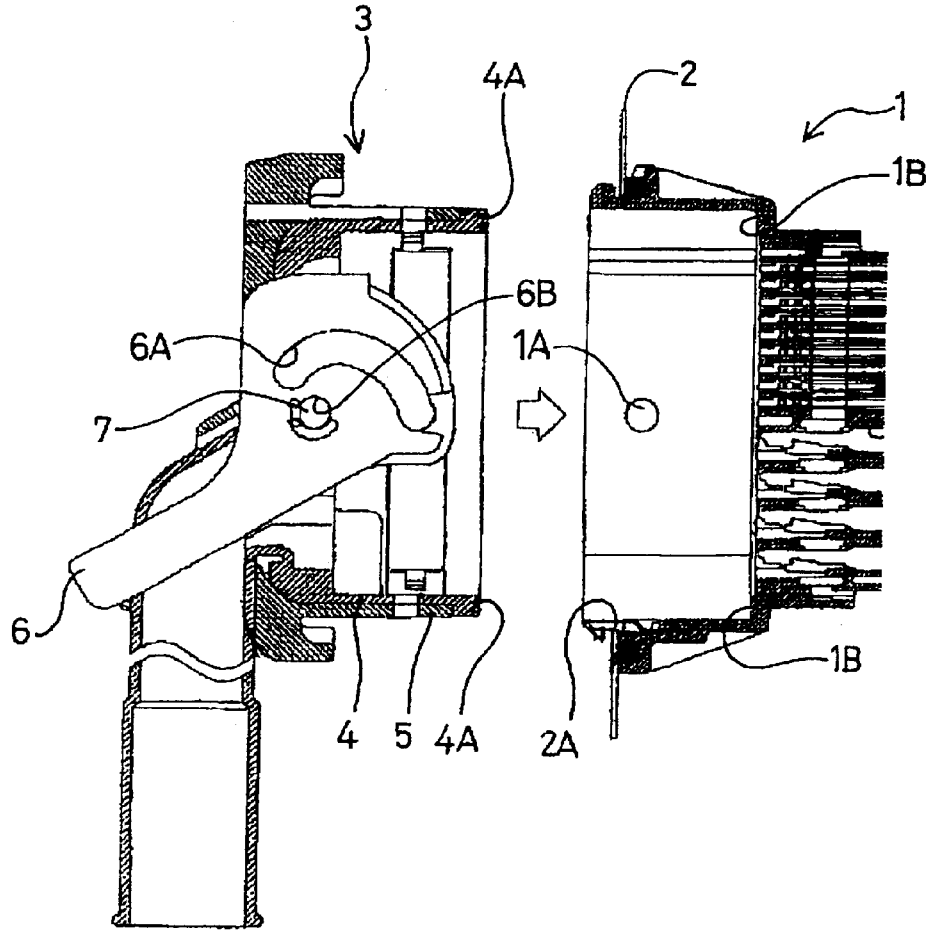
FIG. 7 PRIOR ART
FIG. 7 is a side view partly in section of prior art waiting-side and watertight housings.

A second embodiment of the invention is described with reference to FIGS. 5 and 6. The second embodiment has an engaging portion 40 formed at the back surface of a receptacle 14. The engaging portion 40 has two tubular squeezing walls 42 that project at a specified spacing to surround the front side of a main body 12 of a waiting-side housing 10. A seal 43 in the form of a tubular wall projects substantially in a connecting direction CD over the substantially the entire periphery of the front end of a grommet 21. A leading end of the seal 43 is formed into a watertight portion 43A preferably having a substantially elliptical cross section or other enlarged cross-section swollen in directions substantially normal to the connecting direction CD.

A distance between opposed surfaces 40A of the engaging portions 40 is smaller than a radial dimension of the watertight portion 43A along the direction normal to the connecting direction CD. The watertight portion 43A may be fit into the engaging portion 40. As a result, the watertight portion 43A is compressed in directions substantially normal to the connecting direction CD between the opposed surfaces 40A, and the leading end of the watertight portion 43A closely contacts a back surface 40B of the engaging portion 40. Since the other construction is same as the first embodiment, no description is given thereon.

The watertight housing 11 of the second embodiment can be fit into the receptacle 14. As a result, the seal 43 enters the engaging portion 40, and the watertight portion 43A is compressed in directions substantially normal to the connecting direction CD between the opposed inner surfaces 40A of the engaging portion 40. Finally, when the connection is substantially completed, the leading end of the watertight portion 43A is held substantially in close contact with the back surface 40B of the engaging portion 40.

As described above, the watertight portion 43A of the second embodiment is compressed substantially normal to the connecting direction CD, and thereby provides sealing between the main body 12 of the waiting-side housing 10 and the watertight housing 11. The watertight portion 43A is fit into the groove defined by the opposed inner surfaces 40A and is compressed in directions substantially normal to the connecting direction CD because the radial dimension of the resilient watertight portion 43A is greater than the radial distance between the opposed inner surfaces 40A. Thus, the same effects as the first embodiment can be obtained. In addition, the watertight portion 43A closely contacts three surfaces, i.e. the opposed inner surfaces 40A and the back surface 40B of the engaging portion 40 in the second embodiment, and sealing can be more secure between the housings 10, 11.

The invention is not limited by the above described and illustrated embodiments. For example, following embodiments also are embraced by the technical scope of the present invention as defined in the claims. Beside the following embodiments, various changes can be made without departing from the scope and spirit of the present invention as defined in the claims.

According to the second embodiment, the seal is held in close contact with the back surface of the engaging portion as well as the opposed inner surfaces when fit into the engaging portion. However, the seal need not have close contact with the back surface.

Although the seal has a substantially elliptical cross section in the second embodiment, the shape of the seal may be changed provided that it is compressed in the directions substantially normal to the connecting direction CD by the engaging portion.

According to the second embodiment, the seal in the form of a projecting wall is provided at the grommet, and the engaging portion in the form of a groove is provided at the waiting-side housing. However, the grommet may have a groove-shaped seal, the waiting-side housing may have an engaging portion engageable with such a seal, and the seal may be compressed in the directions substantially normal to the connecting direction CD by the engaging portion so as to provide sealing.

Even though in the preceding embodiments the movable member has been described wit reference to a lever rotatably provided on the watertight connector, it should be understood that any other movable member, such as a substantially linearly movable member, may be used for displaying a cam action so as to connect or assist the connection of the housings.

What is claimed is:

1. A connector comprising first and second housings connectable with one another along a connecting direction, wherein:

the second housing having a front end and side surfaces extending rearwardly from the front end along the connecting direction;

a grommet mounted over the second housing and sealingly engaging the side surfaces of the second housing adjacent the front end;

a grommet cover mounted over the grommet and being spaced outwardly from the grommet in directions normal to the connecting direction at locations adjacent the front end of the second housing;

the first housing having a receptacle wall mounted over the grommet cover a squeezing wall disposed inwardly from the receptacle wall in directions normal to the connecting direction, the squeezing wall being inserted between the grommet cover and the grommet at locations adjacent the front end of the second housing, such that the squeezing wall is outwardly from the grommet in directions normal to the connecting direction and adjacent the grommet such that the grommet exerts resilient sealing forces against the squeezing wall in directions substantially normal to the connecting direction.

2. The connector of claim 1, wherein a movable member is provided on one of the first and second housings for displaying a cam action to connect the first and second housings with each other.

3. The connector of claim 2, wherein the movable member comprises a lever formed with at least one cam groove, the lever being provided on one of the housings and the other of the housing having at least one cam follower engageable with the cam groove, the cam flower being displaced along the cam groove as the lever is rotated, thereby connecting and separating the second housing with and from the first housing.

4. The connector of claim 1, wherein the squeezing wall is spaced inwardly from the receptacle wall in directions normal to the connecting direction.

5. The connector of claim 4, wherein portions of the grommet cover spaced outwardly from the grommet are inserted between the receptacle wall and the squeezing wall.

6. A connector comprising first and second housing connectable with one another along a connecting direction, wherein:

the second housing having a front end and side surfaces extending rearwardly from the front end along the connecting direction;

a grommet mounted over the second housing and having a seal projecting forwardly along the connecting direction and spaced outwardly from the side surfaces of the second housing adjacent the front end, the seal having an enlarged front end;

a grommet cover mounted over the grommet and being spaced outwardly from the seal of the grommet in directions normal to the connecting direction at locations adjacent the front end of the second housing;

the first housing having a receptacle wall mounted over the grommet cover, two squeezing walls disposed inwardly from the receptacle wall in directions normal to the connecting direction and receiving the seal of the grommet therebetween so that the seal of the grommet is outward from one of said squeezing walls in directions normal to the connecting direction and inwardly from the outer of said squeezing walls in directions normal to the connecting direction, such that the enlarged front end of the seal of the grommet exerts resilient sealing forces against the squeezing walls in directions substantially normal to the connecting direction.

7. The connector of claim 6, wherein a movable member is provided on one of the first and second housings for displaying a cam action to connect the first and second housings with each other.

8. The connector of claim 7, wherein the movable member comprises a lever formed with at least one cam groove, the lever being provided on one of the housings and the other of the housings having at least one cam follower being displaced along the cam groove as the lever is rotated, thereby connecting and separating the second housing with and from the first housing.

9. The connector of claim 6, wherein the two squeezing walls are spaced inwardly from the receptacle wall in directions normal to the connecting direction.

10. The connector of claim 9, wherein the two squeezing walls define inner and outer squeezing walls, the portion of the grommet cover spaced outwardly from the seal of the grommet being inserted between the receptacle wall and the outer squeezing wall.

* * * * *